US009822437B2

(12) United States Patent
Torigoe et al.

(10) Patent No.: US 9,822,437 B2
(45) Date of Patent: Nov. 21, 2017

(54) PROCESS FOR PRODUCING THERMAL BARRIER COATING

(75) Inventors: Taiji Torigoe, Tokyo (JP); Ichiro Nagano, Tokyo (JP); Ikuo Okada, Tokyo (JP); Keizo Tsukagoshi, Tokyo (JP); Kazutaka Mori, Tokyo (JP); Yoshiaki Inoue, Tokyo (JP); Yoshitaka Uemura, Tokyo (JP); Yoshifumi Okajima, Tokyo (JP); Hideaki Kaneko, Tokyo (JP); Masahiko Mega, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 0 days.

(21) Appl. No.: 13/387,206

(22) PCT Filed: Aug. 30, 2010

(86) PCT No.: PCT/JP2010/064691
§ 371 (c)(1),
(2), (4) Date: Mar. 23, 2012

(87) PCT Pub. No.: WO2011/074290
PCT Pub. Date: Jun. 23, 2011

(65) Prior Publication Data

US 2013/0202912 A1 Aug. 8, 2013

(30) Foreign Application Priority Data

Dec. 17, 2009 (JP) ..... 2009-286659

(51) Int. Cl.
*C23C 4/04* (2006.01)
*F01D 5/28* (2006.01)
(Continued)

(52) U.S. Cl.
CPC ..... *C23C 4/04* (2013.01); *C23C 4/02* (2013.01); *C23C 4/06* (2013.01); *C23C 4/10* (2013.01);
(Continued)

(58) Field of Classification Search
CPC ..... Y10T 428/12618; Y10T 428/12611; Y10T 428/12944; Y10T 428/12979;
(Continued)

(56) References Cited

U.S. PATENT DOCUMENTS 6,071,627 A 6/2000 Yasuda et al.
2004/0062954 A1 4/2004 Wang et al.
(Continued)

FOREIGN PATENT DOCUMENTS

EP 2055678 A1 5/2009
JP 9-316665 A 12/1997
(Continued)

OTHER PUBLICATIONS

International Search Report of PCT/JP2010/064691, dated Nov. 2, 2010.
(Continued)

*Primary Examiner* — Michael E La Villa
(74) *Attorney, Agent, or Firm* — Westerman, Hattori, Daniels & Adrian, LLP

(57) ABSTRACT

A process for producing a thermal barrier coating having an excellent thermal barrier effect and superior durability to thermal cycling. Also, a turbine member having a thermal barrier coating that has been formed using the production process, and a gas turbine. The process for producing a thermal barrier coating includes: forming a metal bonding layer (12) on a heat-resistant alloy substrate (11), and forming a ceramic layer (13) on the metal bonding layer (12) by thermal spraying of thermal spray particles having a
(Continued)

particle size distribution in which the 10% cumulative particle size is not less than 30 μm and not more than 100 μm.

2 Claims, 4 Drawing Sheets

(51) Int. Cl.

| | |
|---|---|
| ***C23C 4/12*** | (2016.01) |
| ***C23C 4/10*** | (2016.01) |
| ***C23C 4/02*** | (2006.01) |
| ***C23C 4/06*** | (2016.01) |
| ***C23C 28/00*** | (2006.01) |
| ***C23C 4/11*** | (2016.01) |
| ***C23C 4/134*** | (2016.01) |

(52) U.S. Cl.
CPC ..... *C23C 4/11* (2016.01); *C23C 4/12* (2013.01); *C23C 4/134* (2016.01); *C23C 28/30* (2013.01); *C23C 28/3215* (2013.01); *C23C 28/345* (2013.01); *C23C 28/3455* (2013.01); *F01D 5/28* (2013.01); *F01D 5/284* (2013.01); *F01D 5/286* (2013.01); *F01D 5/288* (2013.01); *Y10T 428/12611* (2015.01); *Y10T 428/12618* (2015.01); *Y10T 428/12931* (2015.01); *Y10T 428/12937* (2015.01); *Y10T 428/12944* (2015.01); *Y10T 428/12979* (2015.01)

(58) Field of Classification Search
CPC ..... Y10T 428/12931; Y10T 428/12937; C23C 4/00; C23C 4/02; C23C 4/06; C23C 4/04; C23C 4/105; C23C 28/30; C23C 28/34; C23C 28/3215; C23C 28/345; C23C 28/3455; C23C 4/127; C23C 30/00; C23C 30/005; C23C 4/10; C23C 4/12; C23C 4/124; C23C 4/128
USPC ..... 428/633, 621, 632, 627, 630, 631, 678, 428/679, 680, 685
See application file for complete search history.

(56) References Cited

U.S. PATENT DOCUMENTS

| | | | | |
|---|---|---|---|---|
| 2008/0167173 | A1* | 7/2008 | Lima et al. | 501/80 |
| 2011/0076413 | A1* | 3/2011 | Margolies et al. | 427/446 |

FOREIGN PATENT DOCUMENTS

| | | | |
|---|---|---|---|
| JP | 2001-348655 | A | 12/2001 |
| JP | 2002-037665 | A | 2/2002 |
| JP | 2002-069607 | A | 3/2002 |
| JP | 2003-129210 | A | 5/2003 |
| JP | 2003-160852 | A | 6/2003 |
| JP | 2007-270245 | A | 10/2007 |
| JP | 4388466 | B2 | 12/2009 |

OTHER PUBLICATIONS

Decision of a Patent Grant dated Jul. 22., 2014, issued in corresponding Japanese application No. 2011-546002, w/concise English-language explanation of relevance. (4 pages).
Extended European Search Report dated Feb. 24, 2014, issued in corresponding European Patent Application No. 10837321.8 (5 pages).
Chinese Decision to Grant a Patent dated Apr. 1, 2014, issued in corresponding Chinese Patent Application No. 201080034127.5 with concise English-language explanation of relevance (3 pages).
A Decision to Grant a Patent dated Feb. 22, 2016, issued in counterpart Korean Patent Application No. 10-2012-7000591. Concise explanation of relevance: "The Decision to Grant a Patent has been received". (3 pages).

* cited by examiner

PROCESS FOR PRODUCING THERMAL BARRIER COATING

TECHNICAL FIELD

The present invention relates to a process for producing a thermal barrier coating having excellent durability, and relates particularly to a process for producing a ceramic layer used as the top coat of a thermal barrier coating.

BACKGROUND ART

In recent years, enhancement of the thermal efficiency of thermal power generation has been investigated as a potential energy conservation measure. In order to enhance the electric power generation efficiency of a power-generating gas turbine, increasing the gas inlet temperature has been shown to be effective, and in some cases this temperature is increased to approximately 1500° C. In order to realize a power generation plant that can be operated at this type of higher temperature, the stationary blades and moving blades that constitute the gas turbine, and the walls of the combustor and the like must be formed of heat-resistant members. However, even though the material used for the turbine blades is a heat-resistant metal, it is unable to withstand the types of high temperature mentioned above, and therefore a thermal barrier coating (TBC) is formed by using a deposition process such as thermal spraying to laminate a ceramic layer composed of an oxide ceramic onto the heat-resistant metal substrate, with a metal bonding layer disposed therebetween, thereby protecting the heat-resistant metal substrate from high temperatures. $ZrO_2$-based materials are used for the ceramic layer, and yttria-stabilized zirconia (YSZ), which is $ZrO_2$ that has been partially or totally stabilized by $Y_2O_3$, is often used because of its comparatively low thermal conductivity and comparatively high coefficient of thermal expansion compared with other ceramic materials.

Depending on the type of gas turbine, it is thought that the turbine inlet temperature may rise to a temperature exceeding 1500° C. In those cases where the moving blades and stationary blades and the like of a gas turbine are coated with a thermal barrier coating comprising a ceramic layer composed of the above-mentioned YSZ, there is a possibility that portions of the ceramic layer may detach during operation of the gas turbine under severe operating conditions exceeding 1500° C., resulting in a loss of heat resistance. Further, recent trends towards improved environmental friendliness are spurring the development of gas turbines having even higher thermal efficiency, and it is thought that turbine inlet temperatures may reach 1600° C. to 1700° C., with the surface temperature of the turbine blades reaching temperatures as high as 1300° C. Accordingly, even higher levels of heat resistance and thermal barrier properties are now being demanded of thermal barrier coatings.

The above-mentioned problem of detachment of ceramic layers composed of YSZ occurs because the crystal stability of YSZ is unsatisfactory under high-temperature conditions, and because the YSZ lacks satisfactory durability relative to large thermal stress. As a result, materials such as $Yb_2O_3$-doped $ZrO_2$ (PTL 1), $Dy_2O_3$-doped $ZrO_2$ (PTL 2), $Er_2O_3$-doped $ZrO_2$ (PTL 3), and $SmYbZr_2O_7$ (PTL 4) have been developed as ceramic layers that exhibit excellent crystal stability under high-temperature conditions and superior thermal durability.

As disclosed in PTL 5, ceramic layers generally employ particles having an average particle size of 10 μm to 100 μm, and are typically deposited by a thermal spraying process.

CITATION LIST

Patent Literature

{PTL 1} Japanese Unexamined Patent Application, Publication No. 2003-160852 (claim 1, and paragraphs [0006] and [0027] to [0030])

{PTL 2} Japanese Unexamined Patent Application, Publication No. 2001-348655 (claims 4 and 5, and paragraphs [0010], [0011] and [0015])

{PTL 3} Japanese Unexamined Patent Application, Publication No. 2003-129210 (claim 1, and paragraphs [0013] and [0015])

{PTL 4} Japanese Unexamined Patent Application, Publication No. 2007-270245 (claim 2, and paragraphs [0028] and [0029])

{PTL 5} Japanese Unexamined Patent Application, Publication No. 2002-69607 (claim 21, and paragraphs [0053] and [0054])

SUMMARY OF INVENTION

Technical Problem

The thermal barrier properties of a ceramic layer can be improved by introducing pores into the ceramic layer. The porosity within a ceramic layer can be controlled by altering the thermal spraying conditions. However, the upper limit for the porosity that can be obtained using a thermal spraying process is approximately 10%. It is thought that further increasing this porosity would be effective in improving the thermal barrier properties of the ceramic layer.

The present invention has been developed in light of the above circumstances, and has an object of providing a process for producing a thermal barrier coating having an excellent thermal barrier effect and superior durability to thermal cycling, and also providing a turbine member having a thermal barrier coating that has been formed using the production process, and a gas turbine.

Solution to Problem

In order to achieve the above object, the present invention provides a process for producing a thermal barrier coating, the process comprising forming a metal bonding layer on a heat-resistant alloy substrate, and forming a ceramic layer on the metal bonding layer by thermal spraying of thermal spray particles having a particle size distribution in which the 10% cumulative particle size is not less than 30 μm and not more than 150 μm.

In one aspect of the above invention, the thermal spray particles preferably have a maximum particle size of 150 μm, and preferably comprise not more than 3% of particles having a particle size of 30 μm, and not more than 8% of particles having a particle size of 40 μm.

Conventionally, the formation of ceramic layers has generally been conducted using thermal spray particles having a particle size distribution close to a normal distribution in which the average particle size is within a range from 10 μm to 150 μm, and more typically from 10 μm to 100 μm. In contrast, in the present invention, as specified by the proportion defined above, the proportion of small particles is reduced, and the ceramic layer is formed using spray particles comprising mainly comparatively large particles. Increasing the 10% cumulative particle size for the thermal spray particles means the proportion of small particles contained within the spray particles is reduced. This results in increased porosity within the ceramic layer, and improved thermal barrier properties for the ceramic layer. Moreover, the generation of fine laminar defects within the ceramic layer is also suppressed, enabling the production of a thermal barrier coating with improved durability to thermal cycling.

The present invention also provides a turbine member comprising a thermal barrier coating formed using the above production process, and a gas turbine comprising the turbine member.

A thermal barrier coating produced using the present invention combines excellent thermal barrier properties with superior thermal cycling durability, and can therefore be applied to 1600° C. class gas turbine members and the like.

Advantageous Effects of Invention

According to the present invention, a ceramic layer having a higher porosity than conventional ceramic layers can be formed, enabling the production of a thermal barrier coating with excellent thermal barrier properties. Further, because fine laminar defects are reduced, the durability of the thermal barrier coating can also be improved.

DESCRIPTION OF EMBODIMENTS

An embodiment of the present invention is described below.

Figure 1:
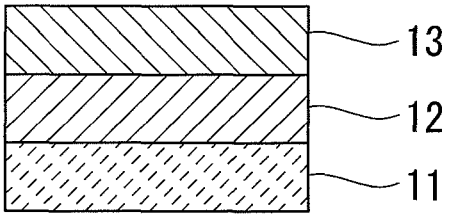
FIG. 1 A schematic illustration of a cross-section of a turbine member comprising a thermal barrier coating.

FIG. 1 is a schematic illustration of a cross-section of a turbine member comprising a thermal barrier coating. A metal bonding layer 12 and a ceramic layer 13 are formed, in that order, as a thermal barrier coating on a heat-resistant alloy substrate 11 such as the moving blade or stationary blade of a turbine.

The metal bonding layer 12 is formed from an MCrAlY alloy (wherein M represents a metal element such as Ni, Co or Fe, or a combination of two or more of these elements) or the like.

Examples of the ceramic layer 13 include YbSZ (ytterbia-stabilized zirconia), YSZ (yttria-stabilized zirconia), $SmYbZr_2O_7$, DySZ (dysprosia-stabilized zirconia) and ErSZ (erbia-stabilized zirconia).

The ceramic layer of the present embodiment is formed by atmospheric pressure plasma spraying. The spray particles used are formed on the metal bonding layer with a particle size distribution in which the 10% cumulative particle size is not less than 30 μm and not more than 150 μm.

Figure 2:
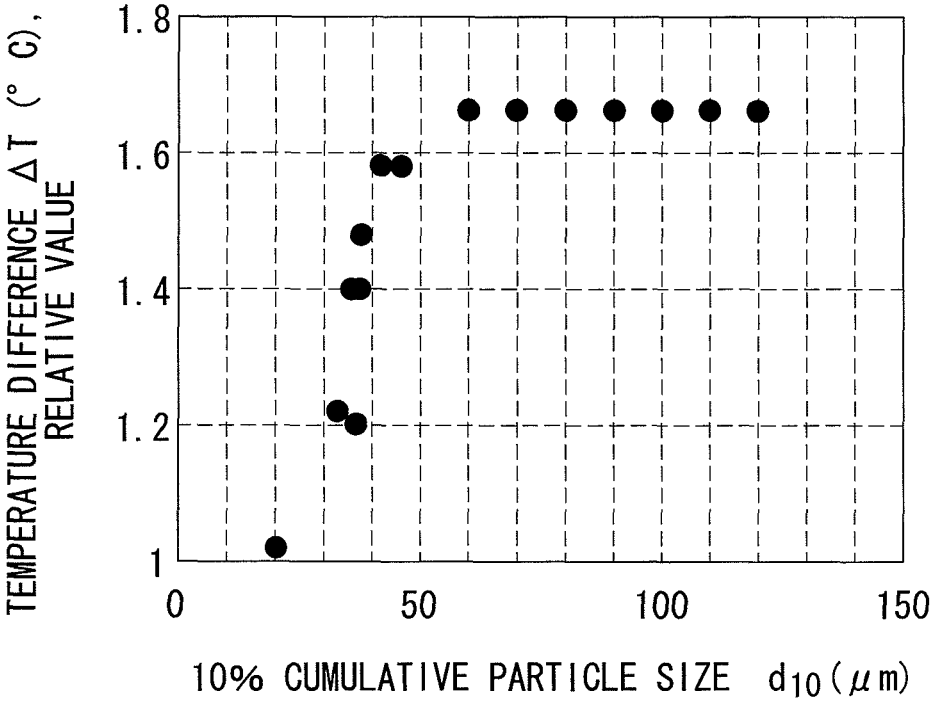
FIG. 2 A graph illustrating the relationship between the 10% cumulative particle size of YbSZ thermal spray particles, and the temperature difference ΔT generated inside the ceramic layer (YbSZ layer) in a thermal cycling durability test.

FIG. 2 illustrates the thermal cycling durability of thermal barrier coatings in which the ceramic layer is formed using YbSZ thermal spray particles having various values for the 10% cumulative particle size. In the figure, the horizontal axis represents the 10% cumulative particle size ($d_{10}$), and the vertical axis represents the temperature difference ΔT (relative value) generated inside the ceramic layer in a thermal cycling durability test. ΔT is defined as the difference between the maximum surface heating temperature and the maximum interface temperature at which the ceramic layer can withstand in excess of 1,000 thermal cycles without being destroyed. ΔT is an indicator of the durability of the ceramic layer in the thermal cycling durability test, with a larger value of ΔT indicating a higher level of durability.

To obtain the graph of FIG. 2, test pieces were prepared by using low-pressure plasma spraying to form a metal bonding layer (Ni: 32% by mass, Cr: 21% by mass, Al: 8% by mass, Y: 0.5% by mass, Co: remainder) of thickness 100 μm on a heat-resistant alloy substrate (brand name: IN-738LC) of thickness 5 mm. A thermal spray gun (F4 gun) manufactured by Sulzer Metco Ltd. was used for the thermal spraying process. The spraying conditions included a spray current of 600 (A), a spray distance of 150 (mm), a powder supply rate of 60 (g/min), an $Ar/H_2$ ratio of 35/7.4 (1/min), and a thickness of 0.5 (mm). The thermal cycling durability was evaluated using a laser thermal cycling test disclosed in the Publication of Japanese Patent No. 4,031,631, under conditions including a heating time of 3 minutes, a cooling time of 3 minutes, a maximum interface temperature of 900° C. and various values for the maximum surface heating temperature, and the number of thermal cycles completed before detachment of the YSZ layer occurred was measured.

The particle size distribution of the thermal spray particles was measured using a laser scattering/diffraction particle size distribution analyzer (manufactured by CILAS).

As illustrated in FIG. 2, when the 10% cumulative particle size is 30 μm or greater, the value of ΔT is at least 600° C., and a ceramic layer having superior thermal cycling durability can be obtained. In other words, using thermal spray particles containing a minimal proportion of small particles improves the thermal cycling durability. Once the 10% cumulative particle size exceeds 60 μm, the thermal cycling durability becomes substantially constant. In consideration of the deposition efficiency, the 10% cumulative particle size for the spray particles used in the present embodiment is preferably not more than 100 μm.

Figure 3:
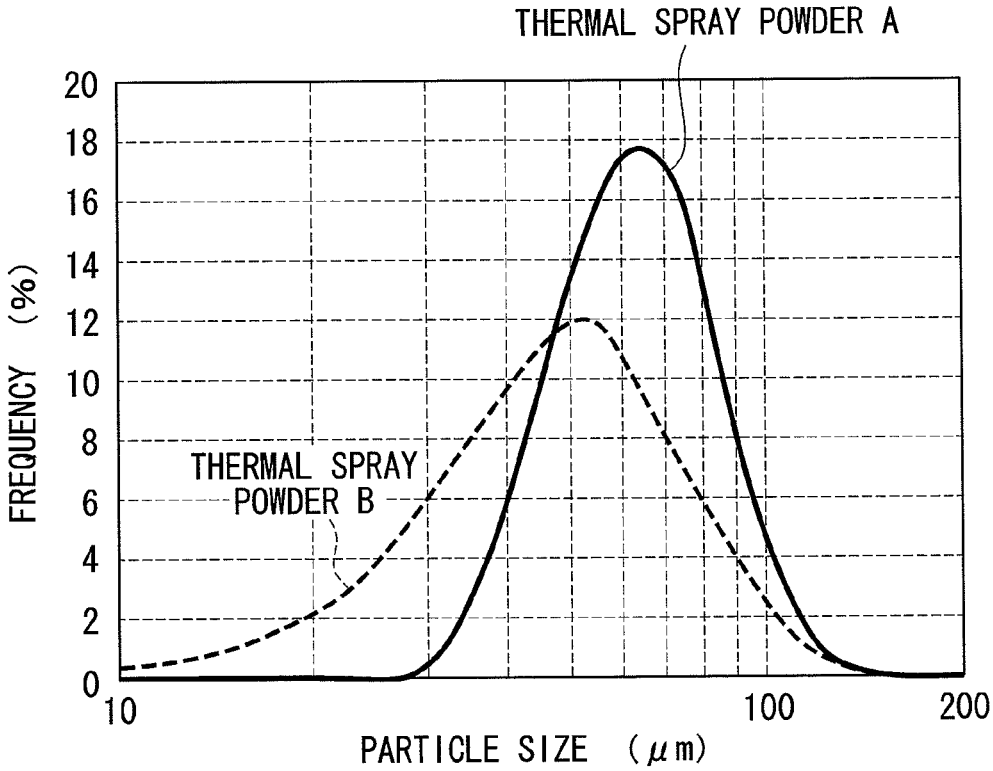
FIG. 3 Particle size distributions of thermal spray particles.

FIG. 3 illustrates the particle size distribution of the YbSZ thermal spray particles. In this figure, the horizontal axis represents the particle size and the vertical axis represents the frequency.

The thermal spray particles A have been classified using a 44 μm sieve to remove those particles having a small particle size. The spray particles A have a maximum particle size of not more than 150 μm, and comprise not more than 1% of particles having a particle size of 30 μm, and not more than 1% of particles having a particle size of 40 μm. The 10% cumulative particle size of the spray particles A is 42 μm.

The thermal spray particles B have not been classified to remove those particles having a small particle size. Although having a maximum particle size substantially similar to that of the spray particles A, the thermal spray particles B comprise 6% of particles having a particle size of 30 μm, and 10% of particles having a particle size of 40 μm. The 10% cumulative particle size of the spray particles B is 21 μm.

The thermal spray particles A and the thermal spray particles B were used to form ceramic layers on test pieces. The test pieces (the materials for the heat-resistant alloy substrate and the metal bonding layer) and the thermal spray conditions used for the ceramic layer were the same as those used in acquiring the data for FIG. 2.

Figure 4:
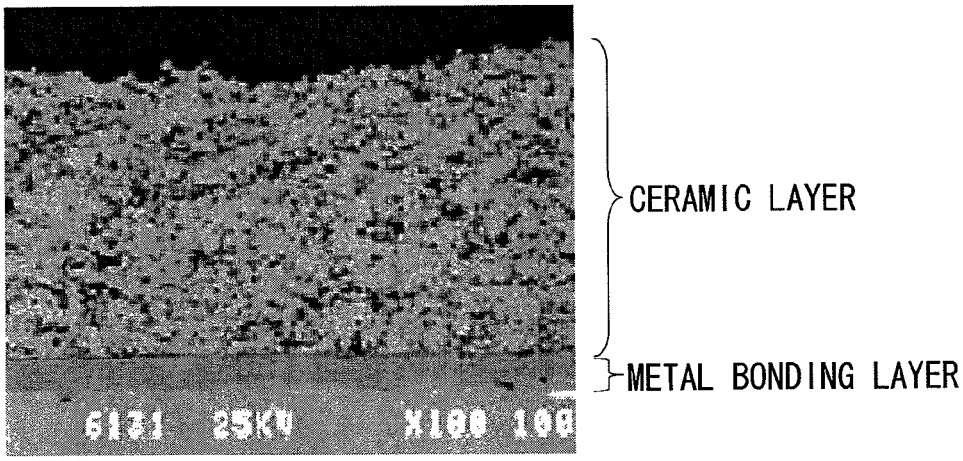
FIG. 4 An SEM photograph of a cross-section of a ceramic layer formed using thermal spray particles A.
Figure 5:
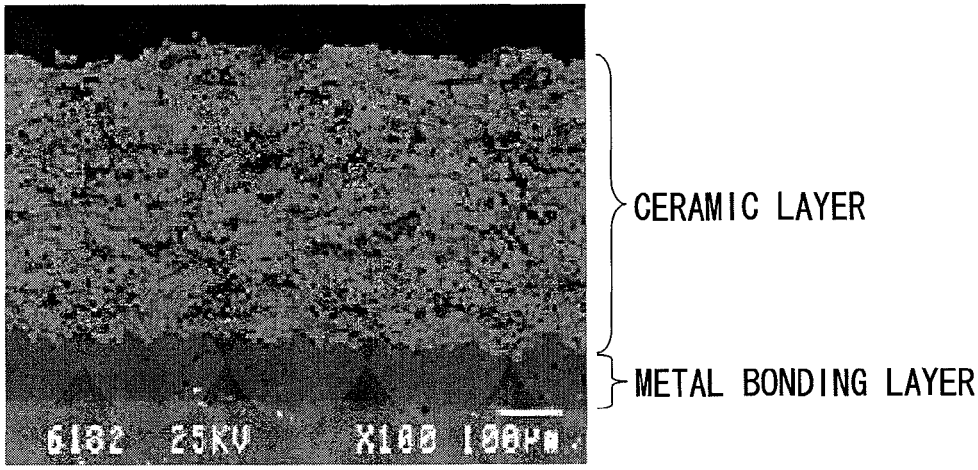
FIG. 5 An SEM photograph of a cross-section of a ceramic layer formed using thermal spray particles B.
Figure 6:
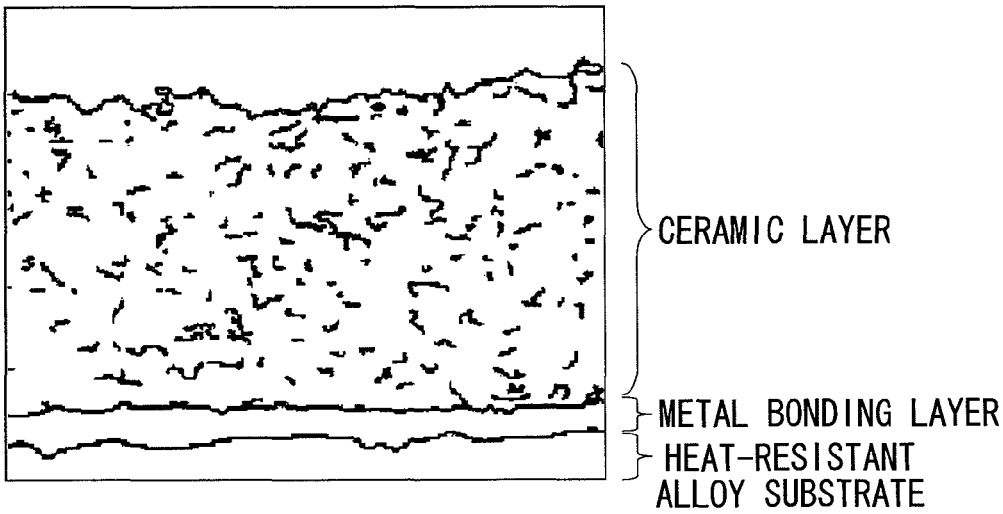
FIG. 6 An image illustrating laminar defects within the SEM photograph of FIG. 4.
Figure 7:
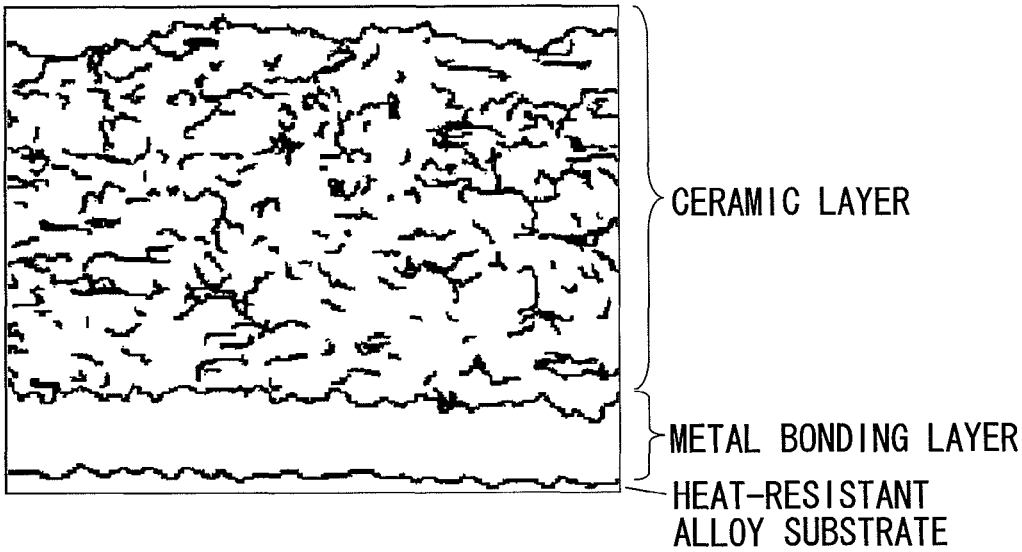
FIG. 7 An image illustrating laminar defects within the SEM photograph of FIG. 5.

FIG. 4 and FIG. 5 are scanning electron microscope (SEM) photographs of cross-sections of thermal barrier coatings prepared using the thermal spray particles A and the thermal spray particles B respectively. FIG. 6 and FIG. 7 are images prepared by performing image processing of the SEM photographs of FIG. 4 and FIG. 5 respectively, and illustrate fine defects (laminar defects) extending from pore origins. Measurement of the thickness of the ceramic layer within FIG. 4 and FIG. 5 revealed a thickness of 470 μm for the ceramic layer of the thermal spray particles A and a thickness of 460 μm for the ceramic layer of the thermal spray particles B.

The thermal barrier coating test pieces prepared using the thermal spray particles A and the thermal spray particles B were measured for porosity of the ceramic layer, thermal conductivity, and the value of the above-mentioned ΔT as an indicator of the thermal cycling durability. The results are shown in Table 1.

The porosity was determined by using an image processing method to analyze microscope photographs of a finely polished cross-section of the thermal barrier coating acquired for 5 random fields of view (observation length: approximately 3 mm) using an optical microscope (magnification: 100×). The thermal conductivity was measured using the laser flash method prescribed in JIS R 1611.

TABLE 1

| | Thermal spray particles A | Thermal spray particles B |
|---|---|---|
| Porosity (%) | 16 | 10 |
| Thermal conductivity (kcal/mh° C.) | 0.9 | 1 |
| ΔT (° C.) | 780 | 510 |

Figure 8:
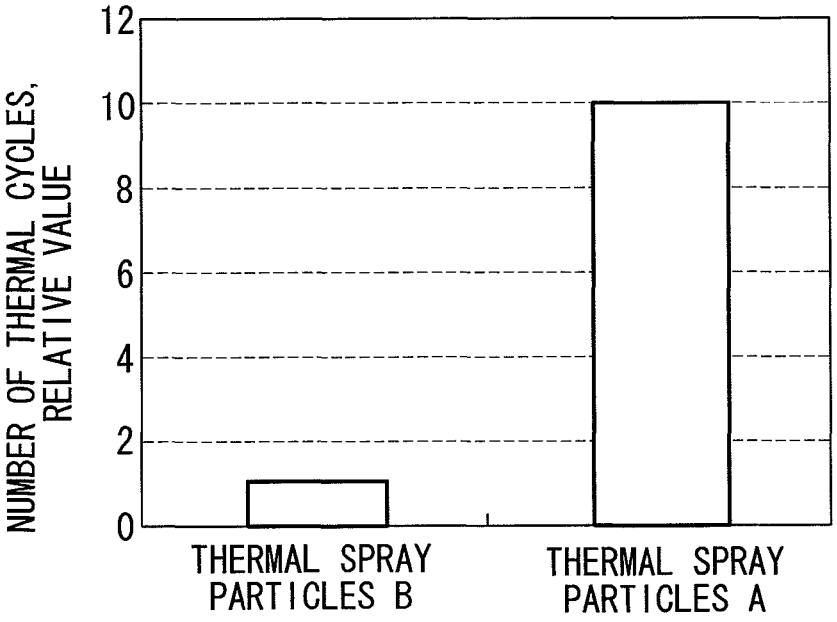
FIG. 8 A graph illustrating the thermal cycling durability of thermal barrier coatings having ceramic layers formed using thermal spray particles with different particle size distributions.

The number of thermal cycles (relative value) endured when the above thermal barrier coating test pieces were subjected to a laser thermal cycling test under conditions including a maximum surface heating temperature of 1500° C., a maximum interface temperature of 900° C., a heating time of 3 minutes and a cooling time of 3 minutes are illustrated in FIG. 8. In this figure, the vertical axis represents the number of thermal cycles completed before destruction of the ceramic layer, reported relative to a value of 1 for the result obtained with the thermal spray particles B.

Compared with the ceramic layer formed using the thermal spray particles B, the ceramic layer formed using the thermal spray particles A has increased porosity and a thermal conductivity that is approximately 10% lower. This increase in the porosity within the ceramic layer formed using the thermal spray particles A is due to the removal of the small particles and the resulting increase in the average particle size.

As illustrated in FIG. 6 and FIG. 7, a plurality of laminar defects were observed in the ceramic layer formed using the thermal spray particles B. It is thought that this is due to the large proportion of fine particles within the thermal spray particles B. In contrast, in the ceramic layer formed using the thermal spray particles A, it was confirmed that because the proportion of fine particles was minimal, the occurrence of laminar defects was able to be suppressed.

As illustrated in Table 1 and FIG. 8, the thermal cycling durability increased dramatically for the thermal barrier coating formed using the thermal spray particles A. This result suggests that particles having a particle size of 40 μm or less contribute to the generation of laminar defects, and also that these laminar defects have an adverse effect on the thermal cycling durability of the coating.

Even when a ceramic layer of the thermal spray particles A was formed using different thermal spray conditions (such as a different spray distance), thermal cycling durability that was substantially equivalent to that illustrated in Table 1 and FIG. 8 was obtained. This result suggests that the thermal spray conditions have almost no effect on the generation of laminar defects.

As described above, by using thermal spray particles in which the number of small particles (for example, particles having a particle size of 40 μm or less) has been dramatically reduced, the porosity of the ceramic layer can be increased, and a thermal barrier coating that exhibits superior thermal barrier properties and excellent thermal cycling durability can be obtained.

Similarly, it has been confirmed that in the cases of YSZ and $SmYbZr_2O_7$ and the like, by forming a thermal barrier coating using thermal spray particles from which small particles have been removed in the same manner as that described above, the porosity of the ceramic layer increases and the thermal cycling durability improves.

REFERENCE SIGNS LIST

11 Heat-resistant alloy substrate
12 Metal bonding layer
13 Ceramic layer

The invention claimed is:

1. A process for producing a thermal barrier coating, the process comprising:

forming a metal bonding layer on a heat-resistant alloy substrate;

removing small size particles from material thermal spray particles using a sieve of a predetermined size mesh which can allow the small size particles to pass through, thereby obtaining thermal spray particles having a particle size distribution in which a 10% cumulative particle size is not less than 40 μm and not more than 50 μm, in which the thermal spray particles have a maximum particle size of not more than 150 μm, in which particles having a particle size of 30 μm are not more than 3% of the thermal spray particles, and in which particles having a particle size of 40 μm are not more than 8% of the thermal spray particles, and forming a ceramic layer on the metal bonding layer by thermal spraying of the thermal spray particles.

2. A process for producing a thermal barrier coating, the process comprising:

forming a metal bonding layer on a heat-resistant alloy substrate for a gas turbine;

removing small size particles from material thermal spray particles which are selected from the group consisting of YbSZ, YSZ, $SmYbZr_20_7$, DySZ, and ErSZ using a sieve of a predetermined size mesh which can allow the small size particles to pass through, thereby obtaining thermal spray particles having a particle size distribution in which a 10% cumulative particle size is not less than 40 μm and not more than 50 μm, in which the thermal spray particles have a maximum particle size of not more than 150 μm, in which particles having a particle size of 30 μm are not more than 3% of the thermal spray particles, and in which particles having a particle size of 40 μm are not more than 8% of the thermal spray particles; and forming a ceramic layer on the metal bonding layer by thermal spraying of the thermal spray particles.

* * * * *